US005628409A

United States Patent [19]

Thomas

[11] Patent Number: 5,628,409

[45] Date of Patent: May 13, 1997

[54] THERMAL IMAGING REFUSE SEPARATOR

[75] Inventor: Daniel W. Thomas, Washougal, Wash.

[73] Assignee: Beloit Technologies, Inc., Wilmington, Del.

[21] Appl. No.: 667,288

[22] Filed: Jun. 20, 1996

Related U.S. Application Data

[63] Continuation of Ser. No. 382,351, Feb. 1, 1995, abandoned.

[51] Int. Cl.[6] ..... B07C 5/00

[52] U.S. Cl. ..... 209/577; 209/930; 209/939

[58] Field of Search ..... 209/577, 587, 209/930, 939, 920, 524

[56] References Cited

U.S. PATENT DOCUMENTS

| | | | |
|---|---|---|---|
| 3,545,610 | 12/1970 | Kelly et al. | 209/920 X |
| 5,134,291 | 7/1992 | Ruhl, Jr. et al. | 209/587 X |
| 5,277,320 | 1/1994 | Corkill et al. | 209/939 X |
| 5,344,026 | 9/1994 | Booth et al. | 209/939 X |
| 5,489,778 | 2/1996 | Burmester et al. . | |

FOREIGN PATENT DOCUMENTS

| | | | |
|---|---|---|---|
| 277872 | 8/1988 | European Pat. Off. . | |
| 2697450 | 5/1994 | France . | |
| 4239479 | 5/1994 | Germany . | |
| 4316977 | 11/1994 | Germany . | |
| 969581 | 9/1964 | United Kingdom | 209/577 |
| 2278440 | 11/1994 | United Kingdom . | |
| 9425186 | 11/1994 | WIPO | 209/939 |

*Primary Examiner*—David H. Bollinger
*Attorney, Agent, or Firm*—Dirk J. Veneman; Raymond W. Campbell

[57] ABSTRACT

A garbage separation apparatus utilizes a vibrating conveyor to form a thin layer of individual items in a stream of municipal waste. The individual items of municipal waste are then transferred to conveyor belts in spaced apart relation. The conveyor belt passes the items of municipal waste under an array of infrared lamps. Immediately after being illuminated by the infrared lamps, the items of municipal waste are imaged by an infrared video system. The infrared video camera produces a video image wherein specific colors refer to a specific range of temperatures. The output of this video camera is processed to separate mono-temperature images which are processed so as to drive the actuation of individual vacuum grippers out of an array of vacuum grippers placed over the conveyor belt transporting the items of municipal waste. The actuation commands derive from a particular thermal-image depicting a particular range of temperatures and are transmitted to a sequentially arranged adjacent array of vacuum grippers. Thus items of municipal waste may be separated based on their thermal properties.

14 Claims, 3 Drawing Sheets

42
44
64
65
56
68
66
60
62
61
58
54
72
74
26
22
70

THERMAL IMAGING REFUSE SEPARATOR

This is a continuation of application Ser. No. 08/382,351 filed on Feb. 1, 1995 abandon.

FIELD OF THE INVENTION

The present invention relates generally to refuse separators and sorters and more specifically to refuse separators employing vision systems.

BACKGROUND OF THE INVENTION

Communities throughout the United States are requiring a larger percentage of all municipal waste to be recycled in order to minimize landfill disposal of municipal waste. Recycling of municipal waste, in most circumstances, requires separating the waste stream into its constituent parts. One way to achieve this is to require the producer of the waste to separate the material into various categories, for instance, plastic, glass, paper and aluminum cans and foil. With many motivated citizens participating, this can be a highly effective way of separating waste. However, in many circumstances, it will not prove cost effective. The collection of multiple receptacles filled with differing wastes can significantly increase the cost of collection which is a major component in the cost of disposing of municipal wastes. In many circumstances, it will not prove possible to pre-separate the trash before collection with the result that undifferentiated trash must be processed and separated if a major fraction of the material is to be recycled.

Numerous material separation processes borrowed from the scrap industry or the mining industry may be applied to municipal wastes. For instance, magnetic separation of ferrous materials may be readily applied to a stream of municipal wastes moving on a conveyor belt. However, often the separation techniques require that the material be comminuted or crushed to a uniform size in order for the separation techniques to be applied.

While separation of a granulized waste stream may facilitate the recovery of some constituents, such as glass, by sorting the material on the basis of density, such processes often degrade the quality of the recovered material for further use. In the case of glass, for example, the more valuable clear glass becomes commingled with the less valuable dark brown and green glasses. Similarly, once plastic containers have been ground, it is no longer as practical to separate the plastic in the waste stream into its various types, thus substantially reducing the value of the recovered materials.

A solution to the problem associated with particularizing the waste is to separate the waste before the constituents are ground up for reprocessing. Unfortunately, this has usually resulted in the necessity of utilizing garbage picking lines where individual laborers remove the different constituents of the waste as it flows along a conveyor. Picking lines are labor-intensive and thus expensive. Cost is even higher if the waste is contaminated with hazardous material such as medical wastes, diapers, and various fibers or toxic materials. Presence of such hazardous materials necessitates the use of safety equipment which is not only expensive, but can reduce the laborers' efficiency in separating materials from the waste stream.

A typical waste stream is composed of paper, plastic, glass, non-ferrous metals, and organic wastes. These materials are normally visually distinguishable and thus can be separated with manual labor.

What is needed is a method and apparatus which can separate the various components of municipal waste automatically in a way that is analogous to the manual labor used on garbage picking lines.

SUMMARY OF THE INVENTION

The garbage separation apparatus of this invention utilizes a vibrating conveyor to form a thin layer of the individual items in a stream of municipal waste. The individual items of municipal waste are then transferred to a conveyor belt spaced apart. The conveyor belt passes the items of waste under an array of infrared lamps. Immediately after being illuminated by the infrared lamps, the waste is imaged by an infrared video system. The individual items of waste take on a characteristic temperature which is dependent on the specific heat, thermal mass, and thermal absorbency of each item. The infrared video camera produces a video image in which each color indicates a specific range of temperatures. The output of this video camera is processed to separate the original image into a plurality of images containing only images of items within a specific temperature range. These mono-temperature images are processed so as to drive the actuation of individual vacuum grippers in an array of vacuum grippers placed over the conveyor belt on which the waste is transported.

The actuation commands derived from a particular thermal image and depicting a particular range of temperatures are transmitted to sequentially arranged adjacent arrays of vacuum grippers. Each vacuum gripper may be extended downward towards the conveyor belt to engage and clamp by applied vacuum an item of waste traveling on the conveyor. The vacuum grippers are moved downwardly by a solenoid which initiates the downward motion of the gripper which in turn connects the gripper to a source of vacuum.

A typical array of vacuum grippers is arranged on four inch centers and for a 24 inch wide conveyor belt would employ six grippers across the belt and four to six grippers along the direction of the belt. The grippers are mounted on a carriage which reciprocates in three mutually perpendicular directions. The first reciprocation is in the vertical direction to remove gripped items of municipal waste from the conveyor belt. The second direction is normal to the conveyor belt to remove the items of municipal waste from over the conveyor belt where they may be discharged onto a separate conveyor belt or into a receptacle. The third direction of reciprocation is parallel to the conveyor belt and moves the array of grippers along with the conveyor belt so that the gripping array is motionless with respect to the conveyor belt and the items of municipal waste traveling thereon during the picking operation performed by the vacuum grippers.

It is a feature of the present invention to provide an apparatus for picking individual items of municipal waste corresponding to a particular material type from a moving stream of municipal waste without the employment of manual labor.

It is another feature of the present invention to decrease the hazards to employees of municipal waste processors by eliminating the hand picking of municipal waste items from a waste stream.

It is a further feature of the present invention to provide an apparatus which can separate municipal waste on the basis of its thermal properties.

It is a still further feature of the present invention to provide a method for separating the municipal waste into its constituent waste streams without the use of manual labor.

Further features, objects, and advantages of the invention will be apparent from the following detailed description taken in conjunction with the accompanying drawings.

DESCRIPTION OF THE PREFERRED EMBODIMENTS

Figure 1:
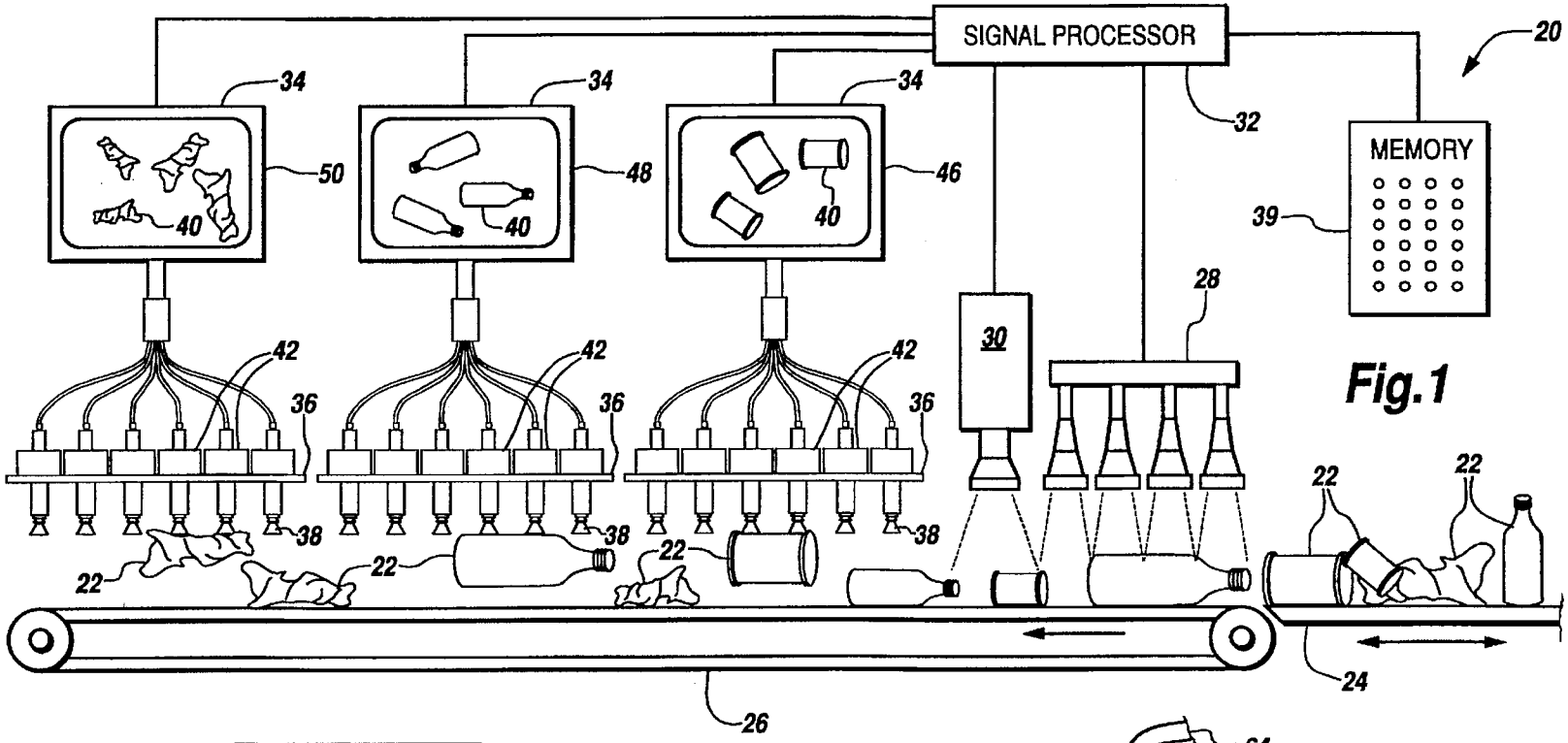
FIG. 1 is a side-elevational, schematic view of the municipal garbage separation apparatus of this invention.

Referring more particularly to FIGS. 1–6 wherein like numbers refer to similar parts, a waste separation system 20 is shown in FIG. 1. Municipal waste 22 is placed on a vibrating conveyor 24 which advances the municipal waste 22 towards a conventional conveyor 26. At the same time, it spreads the material evenly over the conveyor 22 so that individual items of waste 22 are separated from each other and do not overlap. When the waste is transferred to the conventional conveyor 26, it is illuminated by a bank of infrared lamps 28.

The lamps 28 subject the individual items of municipal waste 22 to a uniform quantity of infrared radiation. As a result of being irradiated, each individual item of waste 22 is heated to a temperature which is dependent on the specific heat, thermal mass and absorption characteristics of that particular item of municipal waste 22. Immediately after being irradiated with infrared heat from the lamp bank 28, the items of municipal waste 22 are viewed by a infrared video camera 30.

The camera 30 forms a video image in which specific colors are assigned to imaged objects within a particular range of temperatures. The output of the video camera 30 is sent to a signal processor 32, typically in the form of a general purpose computer. The signal processor divides the image into a series of monochromatic images. Each monochromatic image 34 corresponds to an image of just those items 22 which fall within a particular range of temperatures.

Figure 2:
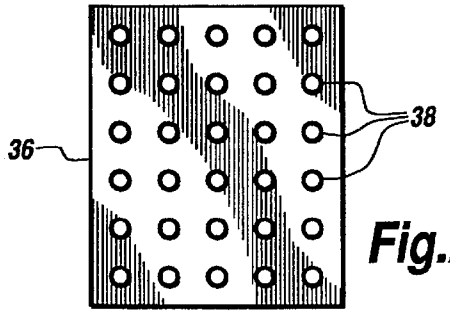
FIG. 2 is a plan view of an array of vacuum grippers employed with the apparatus of FIG. 1.

The signal processor also maps the monochromatic images 34 onto an array 36 of pneumatic grippers as shown in FIGS. 1 and 2. The mapping functions may be performed by any conventional technique, and result in individual vacuum grippers 38 engaging and gripping only those items shown in a particular monochromatic image 34. One way in which this function could be performed, for illustrative purposes only, is to employ an edge finding algorithm for each items of waste 22 imaged in a particular monochromatic image 34. The edge finding algorithm differentiates between the interior and the exterior of the image 40 of an item 22. A map 39 in computer memory of the array of grippers 36 is then overlain or added to the monochromatic image 34. The computer record or stored memory 39 of the gripper positions in the array is then indexed over the monochromatic image 34 to find the position where the maximum number of grippers are contained wholly within the interior of the images 40 of the items of municipal waste 22. When the optimal positioning of the gripper array 36 is determined with respect to the particular items of waste 22, solenoids 42 are activated on those gripper pistons 44 which correspond to individual grippers 38 which are wholly within the images 40. The actuation is according to a timed sequence which brings the grippers 38 into engagement with the municipal waste items 22, thereby gripping items and removing them from the conveyor belt 26.

Figure 3:
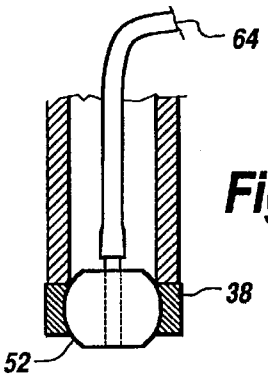
FIG. 3 is a cross-sectional view of an individual gripper of the array of FIG. 2.

As shown in FIG. 1, the signal processor is shown as dividing the output of the video camera into an image 46 representing aluminum cans, an image 48 representing glass bottles, and an image 50 representing paper. The grippers utilized may be one of a number of designs, for example, as shown in FIG. 3, a narrow mouth swivel 52 may be employed. The swivel is designed to present the suction face normal to the surface of waste items 22. A somewhat more conventional vacuum gripper 54 is shown in FIG. 4 which uses the compliance of a rubber bellows arrangement to effect a result similar to that of the vacuum gripper 38.

Figures 4, 5:
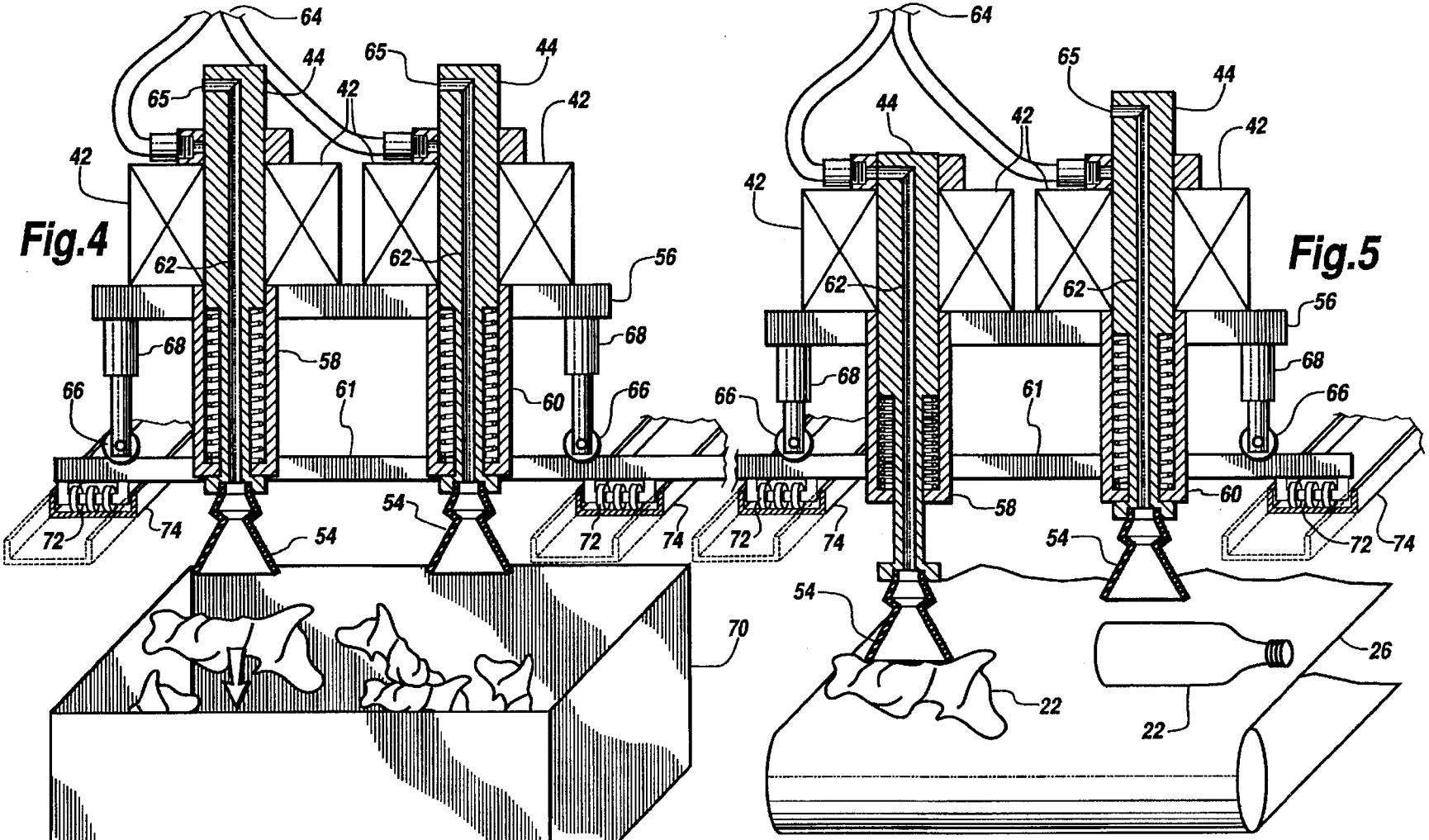
FIG. 4 is an elevational, schematic view of the mechanical portion of the apparatus of FIG. 1 shown positioned over a conveyor.
FIG. 5 is an elevational, schematic view off he apparatus of FIG. 4 positioned over a waste receptacle.

FIG. 4 illustrates a reciprocating mechanism 56 which may be utilized to accomplish the separation of municipal waste 22 as illustrated in FIG. 1. For illustrative purposes, FIG. 4 shows only two grippers, though typically the grippers will be spaced four inches on center and thus for a twenty-four inch conveyor belt, six grippers across will be utilized. FIG. 4 shows a gripper carriage 56 on which are mounted two gripper pistons 44. The pistons are actuated by solenoids 42.

A first gripper mechanism 58 is shown in the actuated position and a second gripper mechanism 60 is shown in the unactuated position. The gripper pistons 44 have vacuum passages 62 which when actuated are connected to a vacuum source 64. The vacuum passages 62 are open vents 65 and allow air in to the grippers 54 when mechanism 60 is in the unactuated position as in FIG. 4. Thus, actuation of the piston 44 by the solenoid 42 performs two functions: That of moving the gripper 54 down towards the belt 26 to engage an item of municipal waste 22; and that of connecting the gripper 54 to a source of vacuum so that the item of municipal waste will be retained on the gripper 54.

The carriage 56 is mounted on rollers 66 by vertical actuation cylinders 68 which raise the carriage as shown in FIG. 5 to lift the items of waste 22 off the conveyor 26. When the carriage 56 is raised, an actuator (not shown for clarity) moves the carriage 56 above a waste receiving receptacle or storage bin 70 where the gripper is retracted by opening the solenoid 42 which causes the piston 44 to retract. This causes the vacuum source 64 to be disconnected from the actuator 54 which releases the gripped item 22.

The transverse track 61 on which the wheels 66 ride is mounted by bearings 72 to a parallel track 74. It may be moved along the track by actuators (not shown). The bearings 72 together with the track 74 and actuator 76 allow the carriage and the grippers 44 mounted thereon to move in tandem with the conveyor belt 26. Thus the grippers 54 may engage items 22 on the belt with zero relative motion between the grippers 54 and the waste 22.

FIG. 1 illustrates the utilization of a multiplicity of arrays 36 of grippers 38, wherein each array 36 is used to remove a particular class of waste 22 from a moving conveyor 26.

An alternative approach is to utilize a single gripping array which removes all of the trash from the moving conveyor. The trash is then selectively released based on the processed images 34 from the signal processor 32. A carriage with the vacuum grippers is made to traverse over a plurality of storage bins so that the different components of the waste are deposited in different storage bins. A structure similar to that illustrated in FIGS. 4 and 5 could be employed to utilize this alternative technique, or an alternative waste separation system 120, shown in FIG. 6, could be utilized.

Figure 6:
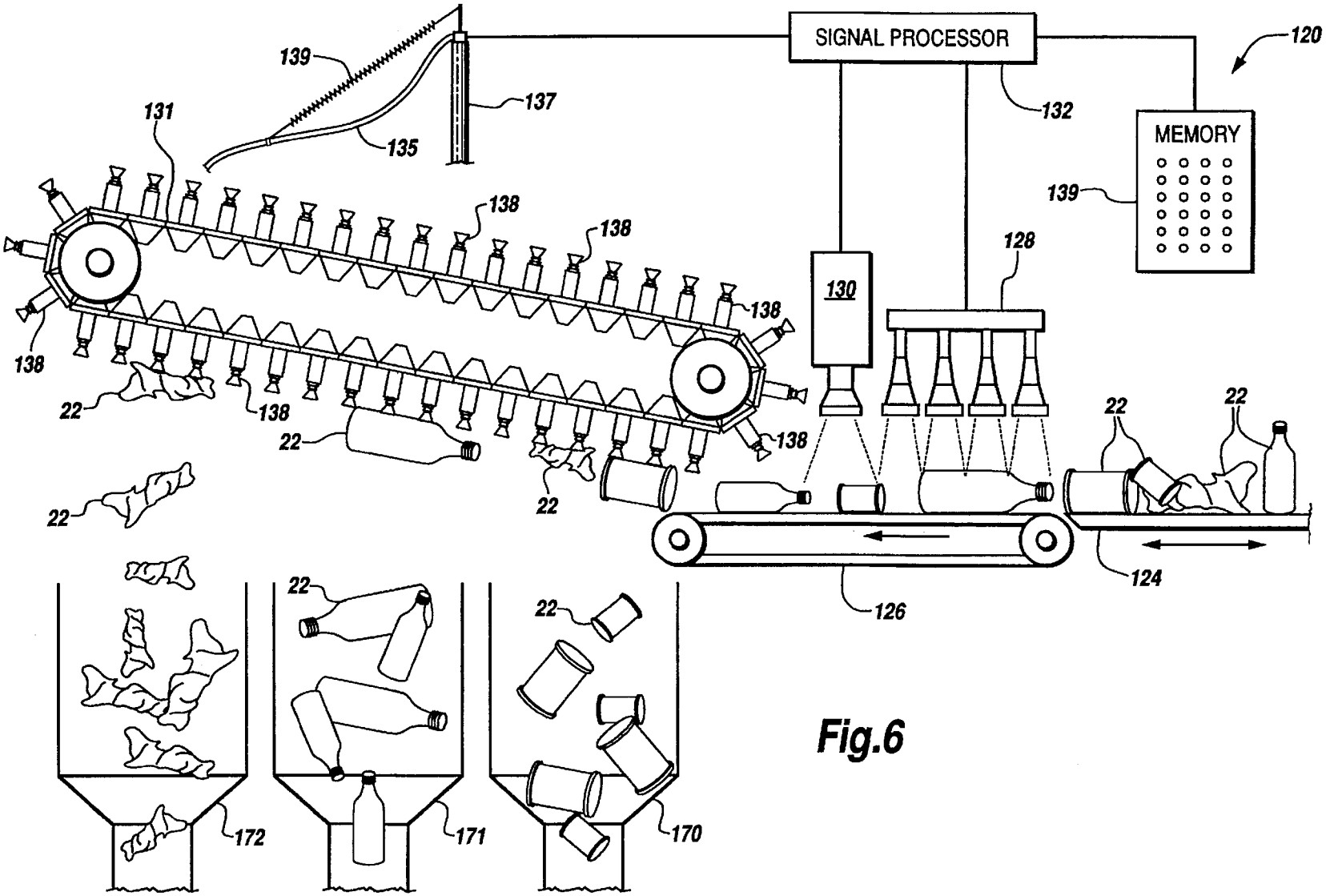
FIG. 6 is a side-elevational, schematic view of an alternative embodiment of the municipal garbage separation apparatus of FIG. 1.

The alternative system 120, shown in FIG. 6, has a vibrating conveyor 124 which conveys and spaces apart items 22 of municipal waste. The spaced apart waste items are then transferred to a conventional conveyor 126 where they are illuminated by a rack of infrared lamps 128. Immediately after being illuminated, the waste items 22 are imaged by an infrared video camera 130. A conveyor 131, having a plurality of grippers 138, is positioned over the conveyor 126 upon which the imaged items of waste ride. The conveyor 131 matches speeds with the conventional conveyor 126 which then brings the grippers 138 into contact with the items of waste disposed thereon.

The infrared camera 130 forms a video image in which specific colors are assigned to imaged objects within a particular range of temperatures. The output of the video camera 130 is sent to a signal processor 132, typically in the form of a general purpose computer. The signal processor 132 divides the image into a series of monochromatic images. Each monochromatic image corresponds to just those items 122 which fall within a particular range of temperatures.

The signal processor maps the monochromatic images onto a section of the grippers 138 as they traverse a portion of the conveyor 131 which is disposed above a storage bin 170 for items which correspond to a particular monochromatic image. The vacuum is then released from the grippers corresponding to that monochromatic image such that just those items fall into the storage bin 170. In a similar way, as the conveyor traverses storage bins 171 and 172, additional monochromatic images are used to release the vacuum grippers holding that class of items. Power, vacuum, and control can be transmitted to the moving conveyor 131 by one or more lines or cables 135 suspended from a support 137. The cable typically employs a spring 139 to accommodate the variations in length of the cable 135 as it traverses about the circuit of the conveyor 131.

It should be understood that the signal processor 32, 132 may be a stand-alone microprocessor or a PC or it may be a time-shared industrial mainframe.

While the apparatus is illustrated and described as employing pneumatic actuators and solenoid actuators, it should be understood that actuators employing hydraulics or rack and pinion actuators driven by electric, pneumatic, or hydraulic motors could be employed. Furthermore, belt-driven or chain-driven reciprocating actuators may be employed. Furthermore, linear induction or linear commutated motors or solenoids could be employed to perform the functions which the pneumatic or solenoid actuators perform in the illustrated embodiments.

It is understood that the invention is not confined to the particular construction and arrangement of parts herein illustrated and described, but embraces such modified forms thereof as come within the scope of the following claims.

I claim:

1. A method for separating a stream of municipal waste into its constituent components, the method comprising the steps of:

distributing and spacing apart a stream of municipal waste items on a conveyor;

irradiating with infrared radiation the stream of municipal waste items with a source of infrared radiation positioned above the conveyor as the stream of municipal waste passes under said infrared source;

imaging with an infrared camera the stream of municipal waste downstream of the infrared source and generating an infrared video signal corresponding to said waste;

processing the signal from the video camera to produce at least one image corresponding to that portion of the video signal which corresponds to locations on the conveyor of waste items having temperatures within a particular temperature range;

controlling grippers in an array of grippers positioned over the conveyor downstream of the camera, to cause actuation and extension toward the conveyor of those grippers in the array corresponding in position to the location of waste items having imaged temperatures within a particular temperature range and griping said waste items; and reciprocating the array of grippers in at least a direction transverse to the direction of the conveyor and releasing the gripped items, so as to selectively remove items of municipal waste from the conveyor having temperatures imaged within a particular temperature range.

2. The method of claim 1 wherein the step of distributing and spacing apart a stream of municipal waste items on the conveyor includes the steps of:

vibrating the waste on a vibrating conveyor which evenly distributes and spaces apart the stream of municipal waste items; and transferring the material vibrated to a conveyor.

3. The method of claim 1 wherein the step of processing the signal from video camera produces a plurality of images, each image corresponding to that portion of a video signal which corresponds to locations on the conveyor of waste items having temperatures within a particular temperature range, and wherein the gripper controlling step includes selectively actuating the vacuum grippers to grip municipal waste items which correspond to a video image of each specific temperature range.

4. An apparatus for separating a stream of municipal waste into its constituent components, the apparatus comprising:

a conveyor for receiving an evenly distributed and spaced apart stream of municipal waste items;

a source of infrared radiation positioned above the conveyor to irradiate a stream of spaced apart municipal waste passing under said infrared source;

a video camera downstream of the infrared source for imaging a stream of municipal waste moving along the conveyor and for generating a video signal corresponding thereto;

a vacuum gripper array positioned along the conveyor, wherein the array has a plurality of vacuum grippers which are extendible toward the conveyor to engage an item of waste;

a carriage on which the vacuum grippers are arrayed, the carriage reciprocating in at least a direction transverse to the direction of motion of the conveyor to selectively remove items of municipal waste from the conveyor; and a signal processor for receiving the video signal from the video camera, wherein the signal processor has a memory corresponding to the positional information of the array of vacuum grippers, and wherein the signal processor has a plurality of memory locations which store an array corresponding to a portion of the video signal which corresponds to locations on the conveyor of waste items having temperatures within a particular temperature range, and wherein the signal processor controls each vacuum gripper in the array, and selectively actuates the vacuum grippers to grip selected waste items which correspond to a video image of items within a specific temperature range.

5. The apparatus of claim 4 further comprising a vibrating conveyor which receives and vibrates a stream of municipal waste to evenly distribute and space apart the stream of municipal waste items, wherein the vibrating conveyor transfers the material to the conveyor.

6. The apparatus of claim 4 further comprising a plurality of vacuum gripper arrays spaced along the conveyor belt, the signal processor having memory locations for receiving a plurality of arrays, each array corresponding to a portion of a video signal received from the video camera which corresponds to a particular and unique temperature range; the signal processor being in controlling connection to each vacuum gripper in each array, and selectively actuating the vacuum grippers in each array so as to grip municipal waste items which correspond to a video image of each specific temperature range.

7. The apparatus of claim 4 wherein the vacuum grippers are actuated by solenoids.

8. The apparatus of claim 7 wherein actuation of the solenoids connects a source of vacuum to each gripper that is actuated.

9. The apparatus of claim 4 wherein the grippers in the array are spaced from each other about four inches.

10. A method for separating a stream of municipal waste into its constituent components, the method comprising the steps of:

distributing and spacing apart a stream of municipal waste items on a conveyor;

irradiating with infrared radiation the stream of municipal waste items with a source of infrared radiation positioned above the conveyor as the stream of municipal waste passes under said infrared source;

imaging with an infrared camera the stream of municipal waste downstream of the infrared source and generating an infrared video signal corresponding to said waste;

processing the signal from the camera to produce at least two images corresponding to that portion of the video signal which corresponds to locations on the conveyor of waste items having at least two different temperatures ranges;

gripping at least a portion of the waste items on an array of grippers;

moving the array of grippers over a plurality of waste receiving bins; and selectively releasing waste corresponding in position on the array to the location of waste items having one of said temperature ranges so as to selectively deposit items of municipal waste from the array having temperatures imaged within a particular temperature range into one of said bins.

11. The method of claim 10 wherein the step of distributing and spacing apart a stream of municipal waste items on the conveyor includes the steps of:

vibrating the waste on a vibrating conveyor which evenly distributes and spaces apart the stream of municipal waste items; and transferring the spaced apart waste to a conveyor.

12. An apparatus for separating a stream of municipal waste into its constituent components, the apparatus comprising:

a conveyor for receiving an evenly distributed and spaced apart stream of municipal waste items;

a source of infrared radiation positioned above the conveyor to irradiate a stream of spaced apart municipal waste passing under said infrared source;

a video camera downstream of the infrared source for imaging a stream of municipal waste moving along the conveyor and for generating a video signal corresponding thereto;

a vacuum gripper array means for engaging items of waste;

a signal processor for receiving the video signal from the video camera, wherein the signal processor has a memory corresponding to the positional information of the array of vacuum grippers, and wherein the signal processor has a plurality of memory locations which store an array corresponding to that portion of a video signal which corresponds to locations on the conveyor of waste items having temperatures within a particular temperature range, and wherein the signal processor controls each vacuum gripper in the array, and selectively actuates the vacuum grippers to release selected waste items which correspond to a video image of items within a specific temperature range.

13. The apparatus of claim 12 further comprising a vibrating conveyor which receives and vibrates a stream of municipal waste to evenly distribute and space apart the stream of municipal waste items, wherein the vibrating conveyor transfers the material to the conveyor.

14. The apparatus of claim 12 wherein the vacuum gripper array means comprises a plurality of grippers which are spaced from each other about four inches.

* * * * *